US006642421B1

(12) United States Patent
Greaney et al.

(10) Patent No.: US 6,642,421 B1
(45) Date of Patent: Nov. 4, 2003

(54) METHOD FOR ISOLATING ENRICHED SOURCE OF CONDUCTING POLYMERS PRECURSORS

(75) Inventors: Mark Alan Greaney, Upper Black Eddy, PA (US); John N. Begasse, Livingston, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/551,659

(22) Filed: Apr. 18, 2000

(51) Int. Cl.[7] ..... C10G 17/00; C10C 1/18
(52) U.S. Cl. ..... 568/579
(58) Field of Search ..... 208/254 R, 45

(56) References Cited

U.S. PATENT DOCUMENTS

| | | | | | |
|---|---|---|---|---|---|
| 2,352,236 | A | * | 6/1944 | Thomas | 196/39 |
| 2,514,997 | A | | 7/1950 | Floyd | 196/24 |
| 2,634,230 | A | | 4/1953 | Arnold et al. | 196/24 |
| 2,664,385 | A | | 12/1953 | Wolf et al. | 196/31 |
| 2,741,578 | A | | 4/1956 | McKinnis | 196/14.4 |
| 2,792,332 | A | | 5/1957 | Hutchings | 196/14.17 |
| 2,848,375 | A | | 8/1958 | Gatsis | 196/39 |
| 2,902,428 | A | | 9/1959 | Kimberlin, Jr. et al. | 208/87 |
| 2,956,946 | A | | 10/1960 | King et al. | 208/263 |
| 3,824,766 | A | | 7/1974 | Valentine et al. | 55/48 |
| 3,837,143 | A | | 9/1974 | Sutherland et al. | 55/32 |
| 3,915,674 | A | | 10/1975 | Smith | 55/48 |
| 3,957,625 | A | | 5/1976 | Orkin | 208/211 |
| 4,242,108 | A | | 12/1980 | Nicholas et al. | 55/40 |
| 4,498,980 | A | | 2/1985 | Forte | 208/321 |
| 4,781,820 | A | | 11/1988 | Forte | 208/333 |
| 4,960,507 | A | | 10/1990 | Evans et al. | 208/254 R |
| 4,960,508 | A | * | 10/1990 | Evans | 208/254 R |
| 4,985,139 | A | | 1/1991 | Madgavkar | 208/321 |
| 5,002,655 | A | * | 3/1991 | Ukegawa et al. | 208/254 R |
| 5,290,427 | A | | 3/1994 | Fletcher et al. | 208/89 |
| 5,298,150 | A | | 3/1994 | Fletcher et al. | 208/89 |
| 5,675,043 | A | * | 10/1997 | Eppig et al. | 568/697 |
| 6,007,705 | A | | 12/1999 | Greaney et al. | 208/251 |

FOREIGN PATENT DOCUMENTS

| | | | |
|---|---|---|---|
| WO | WO 00/71494 A1 | 11/2000 | C07C/7/10 |

OTHER PUBLICATIONS

Derwent Publications Ltd., AN 1997–481174, XP002180257 & CN 1 121 103 (Bejing Inst. Fuel Gas & Coal Chem Eng), Apr. 24, 1996 abstract.
Ullmann's Encyclopedia of Industrial Chemistry, vol. A21, p. 429–447 (1992).

* cited by examiner

*Primary Examiner*—J. Parsa
(74) *Attorney, Agent, or Firm*—Linda M. Scuorzo

(57) ABSTRACT

An embodiment of the present invention is a method for isolating conducting polymer precursors by contacting a non-basic heterocyclic nitrogen containing hydrocarbon stream having a boiling point of from 232° C. (450° F.) to 566° C. (1050° F.) with an effective amount of a treating agent selected from the group consisting of alkylene and polyalkylene glycols and glycol ethers and mixtures thereof, having a molecular weight of less than 1000 and 1200, respectively, at conditions effective to maintain the reactants in a liquid phase to produce a first stream enriched in non-basic heterocyclic nitrogen containing hydrocarbon compounds and a second treated stream having a decreased non-basic heterocyclic nitrogen content. Optionally, an effective amount of a mineral acid may be added to the treating agent to enhance the process.

6 Claims, No Drawings

METHOD FOR ISOLATING ENRICHED SOURCE OF CONDUCTING POLYMERS PRECURSORS

FIELD OF THE INVENTION

The present invention relates to a method for isolating an enriched source of conducting polymer precursors from heterocyclic nitrogen containing hydrocarbon streams.

BACKGROUND OF THE INVENTION

Conducting polymers such as polypyrrole, polyindole, polycarbazole and other polymeric heterocyclic nitrogen containing compounds are valuable commodities (see "Polymers, Electrically Conducting", by Herbert Naarman, in Ullmann's Encyclopedia of Industrial Chemistry, Vol. A21, VCH Publishers, Inc., 1992, pp. 429–447), the potential uses of which include flexible conductive paths in printed circuit boards, heating films, film keyboards, as electrode materials in rechargeable batteries and as polymer coatings in electrochemical sensor devices. These polymers can be synthesized from suitable monomers or precursors by known processes.

Petroleum streams provide potential sources of such monomers or precursors. However, the concentration of these monomers or precursors is typically very low and they are contaminated with similar boiling point materials, which makes their isolation difficult. These monomers or precursors currently are not valuable as fuel sources, and in fact, act as poisons for catalysts, so their removal from the petroleum streams would provide a dual benefit of removing catalyst poisons from the petroleum stream while facilitating the recovery of compounds having value for use as chemical products.

Petroleum streams contain a wide variety or organo-nitrogen species. Therefore, efforts to remove some of these species, due to their deleterious effects on catalysts used in petroleum processing have made. For example, in U.S. Pat. No. 5,675,043 a process is described which removes nitrites from low-boiling petroleum feed stocks for catalytic conversion processes. Therein model nitrile (RCN) containing hydrocarbon streams were treated at lower temperatures, e.g., 16–149° C., (60–300° F.) using solvents meeting a specific formula. The model feeds did not contain heterocyclic nitrogen compounds such as those characteristic of heavy hydrocarbon feeds, e.g., in feeds having a boiling point of 232–566° C. (450° F. to 1050° F.). Additionally, the reference teaches away from the use of higher process temperatures and the reference notes that selection of solvents cannot be easily determined a priori. Actual petroleum streams are complex mixtures of nitrogen containing compounds and other components. Thus one skilled in the art would not be able to extrapolate from the low-boiling nitrile-containing hydrocarbon stream of the reference to treatment of other, higher-boiling streams containing different organo-nitrogen species.

Other patents describe the removal of basic heterocyclic nitrogen species, such as, quinolines from crude oils or fractions by extraction with carboxylic acids (e.g., U.S. Pat. No. 4,985,139 using carboxylic acids; and U.S. Pat. No. 2,848,375 using boric acid and polyhydroxyorganic compounds). In this case, advantage is taken of the basicity of the target molecule to be removed, by reacting it with an acidic extractant. However, the organonitrogen species remaining in the feed after the treatment with acid are believed to be non-basic heterocyclic nitrogen species. The described method is ineffective for their removal. These "non-basic" heterocyclic nitrogen species, e.g., pyrrole, indole, carbazole and their substituted derivatives fall into this class. However, since they are not believed to be as deleterious to catalyst function as are the basic heterocyclic nitrogens, or to have as negative an impact on petroleum product performance, less effort has been directed at their removal.

It would be desirable to develop processes for selectively isolating or recovering these non-basic nitrogen-containing heterocyclic materials useful as precursors to more valuable products. Applicants invention addresses this need.

SUMMARY OF THE INVENTION

An embodiment of the present invention provides for contacting a non-basic heterocyclic nitrogen containing hydrocarbon stream having a boiling point of from 232° C. (450° F.) to 566° C. (1050° F.) with an effective amount of a treating agent selected from polyols, polyol ethers having a number average molecular weight of less than 1000 and 1200, respectively, and mixtures thereof, at conditions effective to maintain the reactants in a liquid phase to produce a first stream enriched in non-basic heterocyclic nitrogen containing hydrocarbons and a second treated stream having a decreased non-basic heterocyclic nitrogen content. Optionally, an effective amount of mineral acid may be added in conjunction with the treating agent. Or, optionally the second treated stream is contacted with an effective amount of polyols and polyol ethers having number average molecular weight of less than 1000 and 1200, respectively, and an effective amount of a mineral acid.

The present invention may comprise, consist or consist essentially of the steps recited and may be practiced in the absence of a step or limitation not disclosed as required.

DETAILED DESCRIPTION OF THE PREFERRED EMBODIMENTS

Electropolymerization reactions require the presence of conducting polymers and appropriate monomers to continue chain growth. For example, to produce polypyrroles, polyindoles or polycarbazoles the corresponding precursor (i.e., monomers) are required; pyrroles, indoles and carbazoles, whether substituted or unsubstituted. By substitution is meant that additional non-interfering organic groups such as alkyl, cycloalkyl, or aryl side-chains may also be found on these monomers. This will typically be the case with monomers derived from petroleum sources.

A preferred embodiment of the present invention provides for a method for, isolating, recovering or concentrating conducting polymer precursors derived from suitable petroleum streams. Thus, the process is useful for producing a concentrate of these precursors.

Certain process streams contain sources of monomers and other subunits or precursors useful for producing conducting polymers. However, such process streams often do not provide these in sufficient concentration or purity, and therefore, have not traditionally been viewed as desirable sources of such precursors. Applicants have discovered a process for recovering and concentrating monomers and other subunits suitable as precursors in the production of conducting polymers from process streams containing them.

These process streams are typically hydrocarbon streams that contain non-basic heterocyclic organo-nitrogen compounds. Optionally, other organonitrogen species may also be present in the stream, but their presence is not required.

These non-basic organonitrogen containing compounds are contained in petroleum streams or fractions having a boiling point of from at least 450° F. to 1050° F. (232–566° C.). Preferably, these streams or fractions should be liquid at process conditions.

By "conducting polymers" it is meant organic nitrogen-containing polymers from electropolymerization reactions. The terms "precursors", "subunits" and the like include monomers, dimers and larger subunits of such organonitrogen containing compounds, e.g., pyrroles, indoles and carbazoles, falling within the above boiling point range of the hydrocarbon streams.

A preferred embodiment of the process provides for contacting a hydrocarbon stream containing such non-basic heterocyclic nitrogen compounds with an effective amount, 10–200% on a volume basis relative to the volume of petroleum feedstock, of a treating agent (solvent) selected from alkylene glycols and polyalkylene glycols, and mixtures thereof. Suitable glycols of the above referenced materials have number average molecular weights of less than 1000, preferably less than 600, and suitable glycol ethers of the above referenced materials have number average molecular weights of less than 1200. Alkylene and polyalkylene glycols include ethylene glycols and polyethylene glycols, respectively, and alkylene and polyalkylene glycol ethers include polyethylene glycol ethers and diethers. More preferably the treating agent is ethylene and polyethylene glycols, e.g., ethylene glycol, di-, tri- and tetra-ethylene glycol, polyethylene glycols (PEGs). Herein "poly" refers to di-, tri-, tetra- and higher units.

Alkylene glycols may be represented by the formula:

$$HO—[CHR_1(CR_2R_3)_n—O]_mH$$

wherein n is an integer from 1–5, preferably 1–2; m is at least 1, preferably 1–20, most preferably 1–8; $R_1$, $R_2$ and $R_3$ are independently selected and may be hydrogen alkyl, aryl, alkylaryl, preferably H and alkyl, preferably 1–10 carbon atoms.

Glycol ethers may be represented by the formula:

$$R_4O—[CHR_5—(CHR_6)_x—O]_yR_7$$

wherein $R_4$, $R_5$, $R_6$ and $R_7$ are independently selected and may be hydrogen, alkyl, provided that $R_4$ and $R_7$ are not both hydrogen; x is an integer of 1–5, preferably 1–2; y is an integer of 1–10, preferably 2–8, most preferably 2–5; $R_4$, to $R_7$ are preferably selected from hydrogen and alkyl groups and when $R_4$, $R_5$, $R_6$ or $R_7$ is an alkyl groups it is preferably 1–10 carbon atoms; more preferably $R_4$ is 1–5 carbon atoms and $R_5$ to $R_7$ is hydrogen.

The treating agent should be liquid or liquefiable at process conditions.

The contacting is carried out at conditions effective to non-destructively remove the non-basic heterocyclic nitrogen compound from the stream. Typically, the temperatures are sufficient to maintain the feedstream in a liquid or fluid state and to enable the treating agent to be effectively distributed in the feedstream to be treated. Such temperatures may be determined by one skilled in the art but can range from 20° C. to 250° C. Pressures are suitably atmospheric pressure to 10,000 kPa but for economic reasons it can be more economical for the process to be carried at autogenous pressure. The treating agent is added in an amount sufficient to decrease and preferably recover all of the non-basic heterocyclic nitrogen-containing compounds from the stream to be treated. Since such streams vary in non-basic heterocyclic-nitrogen content the amount of treating agent may be adjusted accordingly.

Any hydrocarbonaceous stream within the disclosed boiling point range and containing non-basic heterocyclic nitrogen species may be treated by the process disclosed herein, including kerosene, diesel, light gas oil, atmospheric gas oil, vacuum gas oil, light catalytic cracker oil and light catalytic cycle oil.

In another preferred embodiment an effective amount of acid, typically 1 to 10 milliequivalents of mineral acids, such as sulfuric, hydrochloric, phosphoric and phosphorous acid and mixtures thereof may be added to enhance the process. Organic acids such as acetic acid are not as effective as mineral acids in this case. This embodiment of the invention makes possible the removal of both non-basic heterocyclic nitrogen species such as carbazoles but also basic species such as anilines and quinolines both of which are useful to produce conducting polymers. The ratio of basic to non-basic heterocyclic species varies considerably across the range of petroleum streams and in some cases it might be desirable to first extract the non-basic heterocyclic species with unacidified solvent and then in a second extraction with acidified solvent to isolate the basic nitrogen species.

Following separation of the precursor rich extractant phase from the hydrocarbon stream, the heterocyclic nitrogen species can be recovered by means known to those in the art for example by addition of an effective amount of water to the extract which causes the heterocyclic nitrogen molecules to phase separate. This highly concentrated nitrogen-rich phase can be further purified by conventional means as required before being subjected to electrochemical polymerization.

Thus, the process provides a simple method for recovering or concentrating nitrogen compounds from certain hydrocarbon streams desirably without regard to their acidity or alkalinity. The process thus allows for the recovery of these compounds useful in the synthesis of conducting polymers, and provides a feedstream enriched in these components. Also, beneficially, the treated petroleum feedstream will have a decreased nitrogen content as a result.

The invention may be demonstrated with reference to the following examples.

EXAMPLE 1

Nitrogen Removal

Fifty grams of a virgin diesel and fifty grams of a solvent were shaken vigorously in a 250 ml separatory funnel for one minute at 25° C. The two phases were allowed to separate. The nitrogen content of the top phase was determined according to ASTM D-4629, using gas chromatographic analysis using a nitrogen-specific detector (Antek). Table 1 contains the nitrogen removal results obtained for a range of solvents.

TABLE 1

Nitrogen Content Remaining in Feed Following Solvent Extraction

| Solvent | ppm Nitrogen |
|---|---|
| Diesel feed | 37 |
| Ethyleneglycol | 26 |
| Triethyleneglycol | 34 |
| PEG 300 | 23 |
| PEG 400 | 25 |
| PEG 600 | 18 |
| Methoxy PEG 350 | 20 |
| Methoxy PEG 550 | 21 |
| Dimethoxy PEG 250 | 22 |

TABLE 1-continued

| Nitrogen Content Remaining in Feed Following Solvent Extraction | |
|---|---|
| Solvent | ppm Nitrogen |
| Dimethoxy PEG 500 | 22 |
| 2-Methoxyethanol | 28 |
| 2-Ethoxyethanol | 19 |

EXAMPLE 2

Multiple Extraction to Increase Recovery of Nitrogen Species

Extraction were performed as described in Example 1, using 5 gram of feed and 5 gram of solvent. The diesel feed for these experiments had an initial nitrogen content of 103 ppm. Following phase separation, the feed was extracted again with fresh solvent. Nitrogen levels in the feed were determined after each extraction as in Example 1. Table 2 shows the results of repeated extraction with two solvents, polyethyleneglycol 400 (PEG 400) and methoxy polyethyleneglycol 350 (MPEG 350).

TABLE 2

| Nitrogen Content Remaining in Feed Following Repeated Extractions | | |
|---|---|---|
| Extraction | ppm Nitrogen | |
| Number | PEG 400 | MPEG 350 |
| 0 | 103 | 103 |
| 1 | 20 | 20 |
| 2 | 18 | 14 |
| 3 | 10 | 8 |
| 4 | — | 7 |

EXAMPLE 3

Enhanced Removal of Nitrogen by Mineral Acid Addition

Extractions as described in Example 2 were repeated, but with the addition of approximately 0.5 wt % of sulfuric acid to polyethyleneglycol ("PEG") 400 and methoxypolyethyleneglycol ("MPEG") 550. Repeated extractions with fresh acidified solvent were conducted and the nitrogen level in the feed was determined after each extraction as in Example 1. Table 3 contains the results.

TABLE 3

| Nitrogen Content Remaining in Feed Following Repeated Extractions with Acidified Solvents | | |
|---|---|---|
| Extraction | ppm Nitrogen | |
| Number | Acidified PEG 400 | Acidified MPEG 550 |
| 0 | 103 | 103 |
| 1 | 7 | 5 |
| 2 | 5 | 1.5 |
| 3 | 3 | 0.7 |
| 4 | — | 0.7 |

COMPARATIVE EXAMPLE

Addition of Acetic Acid to PEG 400

The procedure used in Example 1 above was repeated, except that. 5 wt % of acetic acid was added to the PEG 400, prior to mixing with the diesel. After extraction with the PEG 400/acetic acid solvent mixture, the feed nitrogen level (determined as in Example 1) dropped from 87 wppm to 35 wppm. This was a lower nitrogen removal than had been achieved with PEG 400 alone (25 wppm). Acetic acid is not as effective an additive as the mineral acids.

EXAMPLE 4

Recovery of Non-basic Nitrogen Heterocyclic Stream

Two liters of virgin diesel were extracted with 500 mls of PEG 400 at room temperature. The PEG 400 was separated from the extracted diesel by use of glass sepatory funnel. An equal volume of water was then added to the PEG 400 extract and it was mixed gently and heated to 95° C. An oily material separated from the extract. This material was isolated. Elemental analysis by combustion showed the nitrogen content to be 0.15 wt %. This represents a factor of seventeen increase in the concentration of nitrogen in the extracted material relative to the initial feed.

EXAMPLE 5

Identification of Organo-Nitrogen Species Removed

The procedure used in Example 1 was conducted on a sample of a virgin diesel. The feed and product diesel were both subjected to gas chromatographic analysis, utilizing a nitrogen-specific detector (Antek) to differentiate the different classes of organo-nitrogen species found in the samples. The initial feed was found to contain 93 ppm of carbazoles, 6 ppm of indoles and 1 ppm of aniline. Following extraction, the product diesel was found to contain 37 ppm of carbazoles, 0 ppm of indoles and 1 ppm of aniline. As can be seen from this data, PEG selectively removes the non-basic nitrogen species (indoles and carbazoles) in preference to the basic nitrogen species, such as anilines.

What is claimed is:

1. A method for isolating conducting polymer precursors and consisting essentially of contacting a non-basic heterocyclic nitrogen containing hydrocarbon stream having a boiling point of from 232° C. (450° F.) to 566° C. (1050° F.) with an effective amount of a treating agent selected from the group consisting of alkylene and polyalkylene glycols having a number average molecular weight of less than 1000, alkylene and polyalkylene glycol ethers having a number average molecular weight of less than 1200 and mixtures thereof, at conditions effective to maintain reactants in a liquid phase to produce a first hydrocarbon stream enriched in non-basic heterocyclic nitrogen containing hydrocarbon compounds and a second treated hydrocarbon stream having a decreased non-basic heterocyclic nitrogen content.

2. The method of claim 1 further comprising adding an effective amount of a mineral acid to the treating agent.

3. The method of claim 1 wherein the hydrocarbon stream is selected from kerosene, diesel, light gas oil, atmospheric gas oil, vacuum gas oil, light catalytic cracker oil and light catalytic cycle oil.

4. The method of claim 1 further comprising contacting the second, treated with an a solution containing a mixture of an agent selected from the group consisting of alkylene and polyalkylene glycols and alkylene and polyalkylene glycol ethers having a number average molecular weight of less than 1000 and less than 1200, respectively, and mixtures thereof and an effective amount of a mineral acid to produce a stream enriched in heterocyclic nitrogen containing hydrocarbon compounds and a treated stream having a decreased heterocyclic nitrogen content.

5. The method of claim 1 wherein the treating agent is selected from ethylene glycol, and polyethylene glycol glycol ethers, polyethylene glycol ethers and diethers.

6. The method of claim 2 or 5 wherein the effective amount of mineral acid is from 1–10 meg.

* * * * *